US009580193B2

(12) United States Patent
Ehrmann

(10) Patent No.: US 9,580,193 B2
(45) Date of Patent: Feb. 28, 2017

(54) CUTTING STATION WITH COMPLETE CUTTING TOOL

(75) Inventor: Elmar Ehrmann, Bad Groenenbach (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 1162 days.

(21) Appl. No.: 13/463,866

(22) Filed: May 4, 2012

(65) Prior Publication Data

US 2012/0283083 A1 Nov. 8, 2012

(30) Foreign Application Priority Data

May 6, 2011 (DE) ..... 10 2011 100 784

(51) Int. Cl.

| | |
|---|---|
| ***B65B 9/04*** | (2006.01) |
| ***B26F 1/40*** | (2006.01) |
| ***B65B 59/04*** | (2006.01) |
| ***B65B 61/06*** | (2006.01) |
| *B26D 7/06* | (2006.01) |
| *B65B 31/00* | (2006.01) |
| *B65B 61/28* | (2006.01) |

(52) U.S. Cl.

CPC ..... *B65B 9/04* (2013.01); *B26F 1/40* (2013.01); *B65B 59/04* (2013.01); *B65B 61/06* (2013.01); *B26D 7/0633* (2013.01); *B26F 2210/06* (2013.01); *B65B 31/00* (2013.01); *B65B 61/28* (2013.01)

(58) Field of Classification Search

CPC ..... B65B 59/04; B65B 61/06; B65B 61/065; B65B 9/04; B65B 61/28; Y10T 83/95; Y10T 83/9478; Y10T 83/6582; B26F 1/40; B26F 2210/06; B26D 7/0633

USPC ..... 53/559, 329.2–329.4, 393

See application file for complete search history.

(56) References Cited

U.S. PATENT DOCUMENTS

| | | | | |
|---|---|---|---|---|
| 3,216,491 | A * | 11/1965 | Brown | B29B 13/023 165/120 |
| 3,685,251 | A * | 8/1972 | Mahaffy | B29C 51/445 53/329.5 |
| 4,297,929 | A * | 11/1981 | Schieser et al. | 83/110 |
| 5,040,403 | A * | 8/1991 | Henderson et al. | 72/446 |
| 5,074,143 | A * | 12/1991 | Nolan et al. | 72/446 |
| 5,307,610 | A * | 5/1994 | Schneider | B29C 51/34 425/384 |

(Continued)

FOREIGN PATENT DOCUMENTS

| | | |
|---|---|---|
| CN | 1462228 | 12/2003 |
| DE | 3118946 A1 | 12/1982 |

(Continued)

OTHER PUBLICATIONS

German Search Report Dated Jan. 12, 2012, Application No. 10 2011 100 784.2, Applicant Multivac Sepp Haggenmueller GmbH & Co. KG.

*Primary Examiner* — Stephen Choi
*Assistant Examiner* — Evan MacFarlane
(74) *Attorney, Agent, or Firm* — Husch Blackwell LLP

(57) ABSTRACT

A thermo-forming packaging machine has a machine frame and a cutting station including a complete cutting tool. The thermo-forming packaging machine includes the complete cutting tool being extractable from the machine frame in a direction of production of the packaging machine.

4 Claims, 6 Drawing Sheets

(56) References Cited

U.S. PATENT DOCUMENTS 5,619,913 A * 4/1997 Padovani ..... B29C 31/006
100/215

FOREIGN PATENT DOCUMENTS

| | | | |
|---|---|---|---|
| DE | 102005039673 | A1 | 11/2006 |
| EP | 1714886 | A1 | 10/2006 |
| GB | 2101030 | A | 1/1982 |
| WO | 0128865 | A1 | 4/2001 |
| WO | 2010064125 | A2 | 6/2010 |

* cited by examiner

CUTTING STATION WITH COMPLETE CUTTING TOOL

CROSS-REFERENCE TO RELATED APPLICATIONS

This application claims foreign priority benefits under 35 U.S.C. §119(a)-(d) to German patent application number DE 102011100784.2, filed May 6, 2011, which is incorporated by reference in its entirety.

TECHNICAL FIELD

The disclosure relates to a thermo-forming packaging machine.

BACKGROUND

Known thermo-forming packaging machines made by the applicant comprise cutting stations with complete cutting tools. Characteristic for a complete cutting tool, which is also referred to as form cutting tool, is that a package is cut from the film composite with it in only a single cutting motion, where the cutting blade has the outer contour of the package. In this, guide columns, which are required for receiving an upper cutting tool and a movable lower cutting tool, are each arranged on both sides between the chain guide for guiding the clip chain, the clip chain itself, and the machine frame. For maintenance purposes or for replacing the complete cutting tool, for example for a change of format, the upper and the lower cutting tool (as well as the guide columns) are removed upwards from the thermo-forming packaging machine. For this, the clip chain and the chain guide must be removed in the region of the cutting station on both sides. This requires a particularly high assembly effort and tong downtime for the thermo-forming packaging machine.

SUMMARY

An object of the thermo-forming packaging machine according to the disclosure is to facilitate exchange of a complete cutting tool.

A thermo-forming packaging machine according to the disclosure comprises chain guides for the film advance chains, a forming station, a sealing station and a cutting station, where the cutting station comprises a complete cutting tool. The thermo-forming packaging machine is designed such that the complete cutting tool is extractable in the direction of production from the thermo-forming packaging machine. In this manner, the film advance chains and the chain guides in the region of the cutting station do not need to be disassembled and the complete cutting tool can be extracted as one unit towards the end of the thermo-forming packaging machine. This results in minimal downtime when changing complete cutting tools. The complete cutting tool can also be configured as a strip puncher.

The complete cutting tool comprises a tool upper part, a tool lower part and guides on which the tool upper part and the tool lower part are moved.

Preferably, the chain guides are in the region of the cutting station in the direction of production arranged freely projecting towards the end of the thermo-forming packaging machine. This overhung mounting leads to the fact that the complete cutting tool is in the direction of production not obstructed during extraction by projecting edges or fasteners on chain guides existing on both sides.

Preferably, there is a deflection wheel provided at the end of each chain guide provided on both sides in the direction of production in order to enable a narrow construction in the vertical direction of the chain guides in order to reduce the space requirement for the chain guides within the complete cutting tool to a minimum.

It is advantageous, if both an upper or leading chain strand of the film advance chains, respectively, as well as a lower or trailing chain strand, respectively, are arranged in the region of the cutting station within the complete cutting tool, in order to enable a simply designed and compact structural shape of the chain guide in the region of the cutting station and beyond.

A machine frame rear end in the direction of production is provided in the direction of production upstream of the cutting station and thus allows an arrangement of the guide columns of the complete cutting tool and the frame for the cutting station on the exterior and close to the chain guides.

Preferably, all vertical guide columns of the complete cutting tool are disposed outside of the chain guide.

The complete cutting tool comprises a cutting tool upper part, a cutting tool lower part and at least two guide columns that connect the cutting tools, where the cutting tool lower part performs a vertical lifting motion on them. Preferably, the chain guides are, on the one hand, provided between the tool lower part and the tool upper part and, on the other hand, between the guide columns transversely to the direction of production.

Preferably, the thermo-forming packaging machine is designed such that a tool change carriage for accommodating the complete cutting tool is able to run-in against the direction of production into the thermo-form packaging machine. This is particularly advantageous for larger complete cutting tools, because the weight during extraction is too much for the operator or a service technician and a tool carriage from an ergonomic perspective ensures simple and safe handling during tool change Preferably, fixation elements are provided at the cutting station for repeat accuracy positioning of the complete cutting tool in the cutting station in order to avoid new additional and complicated adjustment or alignment activities after a change.

The cutting station preferably comprises positioning elements in order to position and/or align the cutting station independently of the machine frame.

In the following, an advantageous embodiment of the disclosure is further explained with reference to the below drawings.

DETAILED DESCRIPTION

Figure 1:
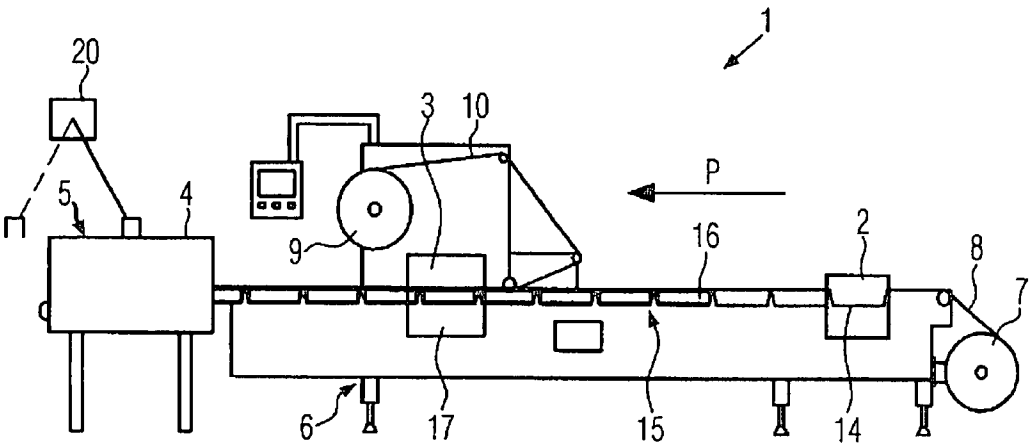
FIG. 1 shows a schematic view of a thermo-forming packaging machine with a complete cutting tool.

Identical components are in the figures designated throughout with the same reference numerals.

FIG. 1 shows a schematic view of a packaging machine 1 in the form of a thermo-forming packaging machine. This thermo-forming packaging machine 1 comprises a forming station 2, a sealing station 3, and a cutting device 5, which are arranged in this sequence in a direction P of production on a machine frame 6.

On the input side, the machine frame 6 has a feed roller 7 disposed on it, from which a first web-shaped material 8 is drawn off. In the region of the sealing station 3, a material accumulator 9 is provided, from which a second web-shaped material 10 is drawn off as a top film. Furthermore, the packaging machine 1 comprises a feed device—not shown—which grips the first web-shaped material 8 and in a main work cycle transports it cyclically in the direction P of processing. The feeding device can be realized for example by laterally arranged clip or transport chains 23 (see FIG. 2).

In the illustrated embodiment, the forming station 2 is formed as a thermo-forming station, in which containers 14 are formed in the first web-shaped material 8 by thermo-forming. In this, the forming station 2 may be designed such that several containers can be formed side by side in the direction perpendicular to the direction P of processing. In the direction P of processing, downstream of the forming station 2, an infeeding stretch 15 is provided in which the containers 14 formed in the first web-shaped material 8 are filled with product 16. The sealing station 3 has a closable chamber 17 in which the atmosphere in the container 14 prior to sealing can be replaced for example by gas flushing with an exchange gas or with an exchange gas mixture and is then sealed with the second web-shaped material 10. The cutting station 5 comprises a complete cutting tool 4. A gripping device 20 is provided for removing individually cut packages 21 from the cutting station and to pass them to a discharge belt—not shown in detail—arranged adjacent to the thermo-forming packaging machine 1.

Figure 2:
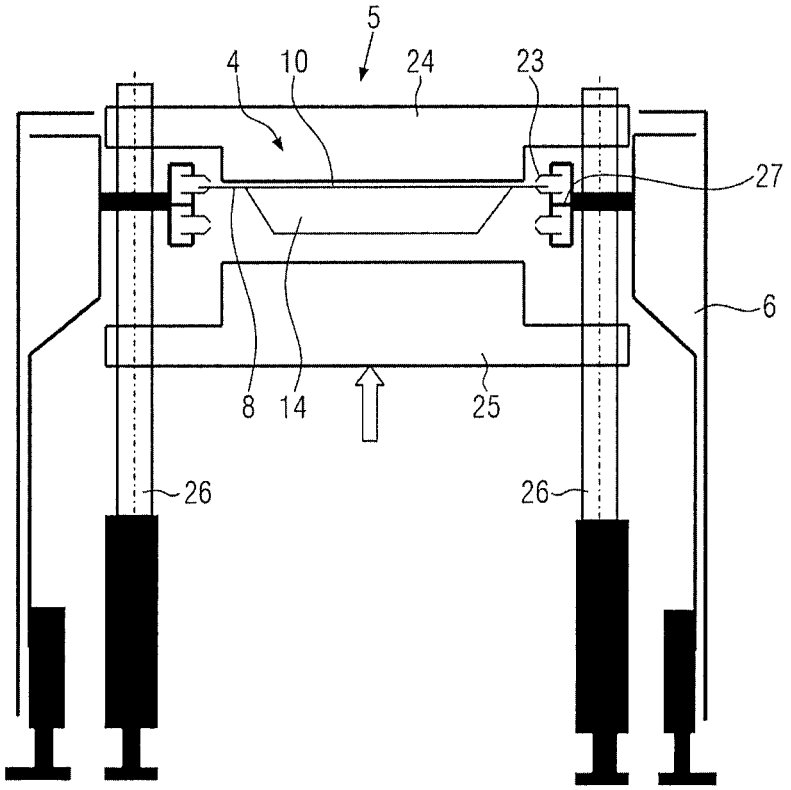
FIG. 2 (Prior Art)
FIG. 2 shows a sectional view through a cutting station with a complete cutting tool in the direction of production according to prior art.

FIG. 2 shows a cutting station 5 with a complete cutting tool 4 in the direction P of production in an opened position according to prior art. Both a tool upper part 24, as well as a vertically movable tool lower part 25 are connected to guides 26. Of the four guides 26, two guides 26 are each arranged on both sides between the machine frame 6 and the transport chains 23. The transport chains 23 on both sides hold the first web-shaped material 8 with the formed container 14 and the second web-shaped material 10.

Figure 3:
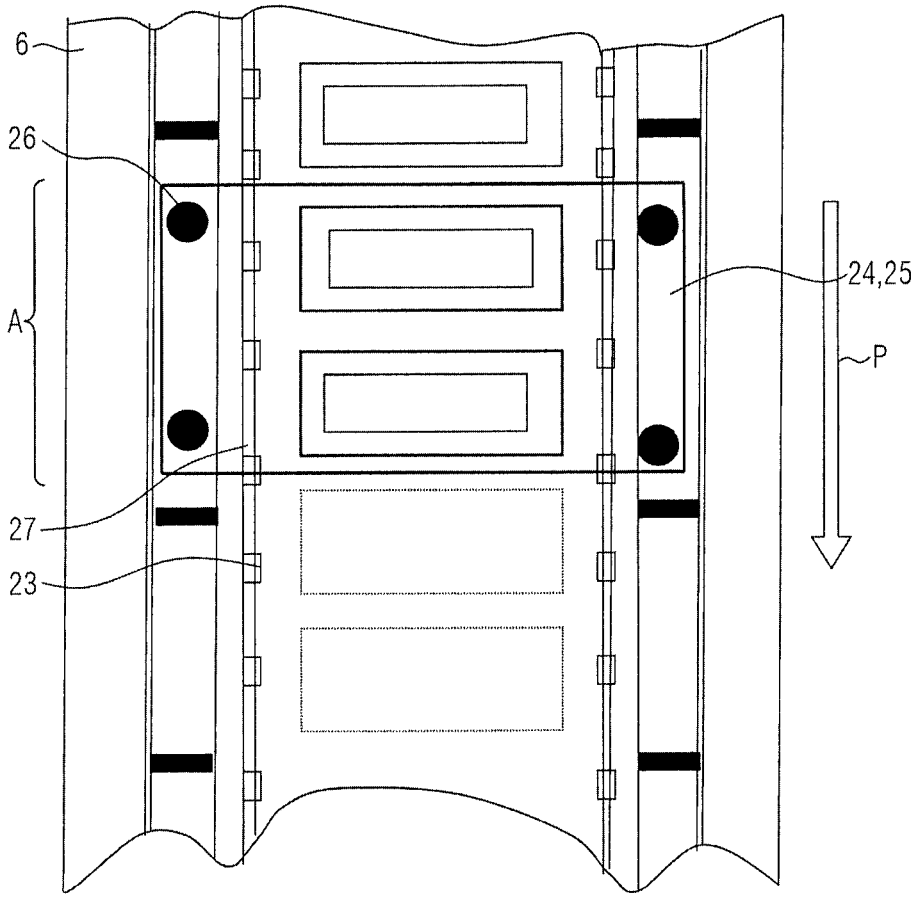
FIG. 3 (Prior Art)
FIG. 3 shows a plan view of a cutting station of FIG. 2 according to prior art.

In order to be able to extract or replace a tool lower part 25, for instance for maintenance purposes or for a format change, a chain guide 27 and the transport chains 23 guided by it need to be extracted in the region A of the cutting station 5 (see FIG. 3). This involves considerable labor input and downtime for the packaging machine 1.

Figure 4:
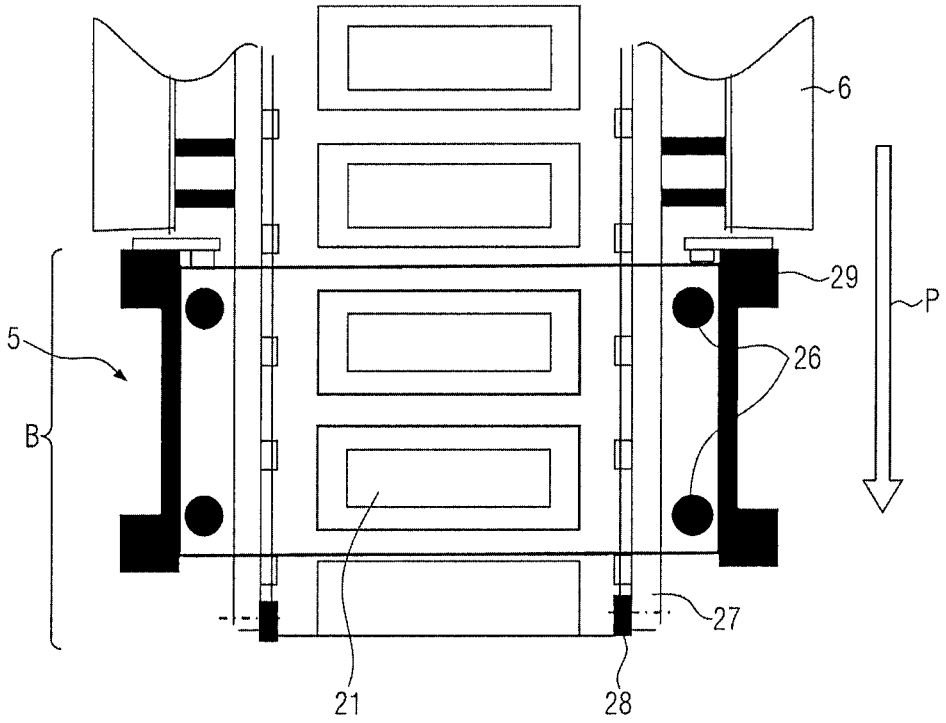
FIG. 4 shows a top view of a cutting station of a thermo-forming packaging machine according to the disclosure.

FIG. 4 shows a region B at the end of the packaging machine 1 according to the disclosure, in which the chain guide 27 is no longer attached to the machine frame 6, but is designed freely projecting in the direction P of production. The machine frame 6 ends already before the downstream region B of the cutting station 5. The cutting station 5 is in the example illustrated designed such that two packages 21 are simultaneously cut. Two guides 26 (e.g., guide columns) are each attached on both sides of a frame 29. Both the frame 29, as well as the guides 26 are located outside of the chain guides 27 for the transport chains 23. The transport chains 23 are deflected at the end of the chain guide 27 by means of deflection rollers or wheels 28, where the upper or leading chain strand (with the mounted first web-shaped material) and the lower or trailing chain strand (without first web-shaped material) run in parallel in the region B.

Figure 5:
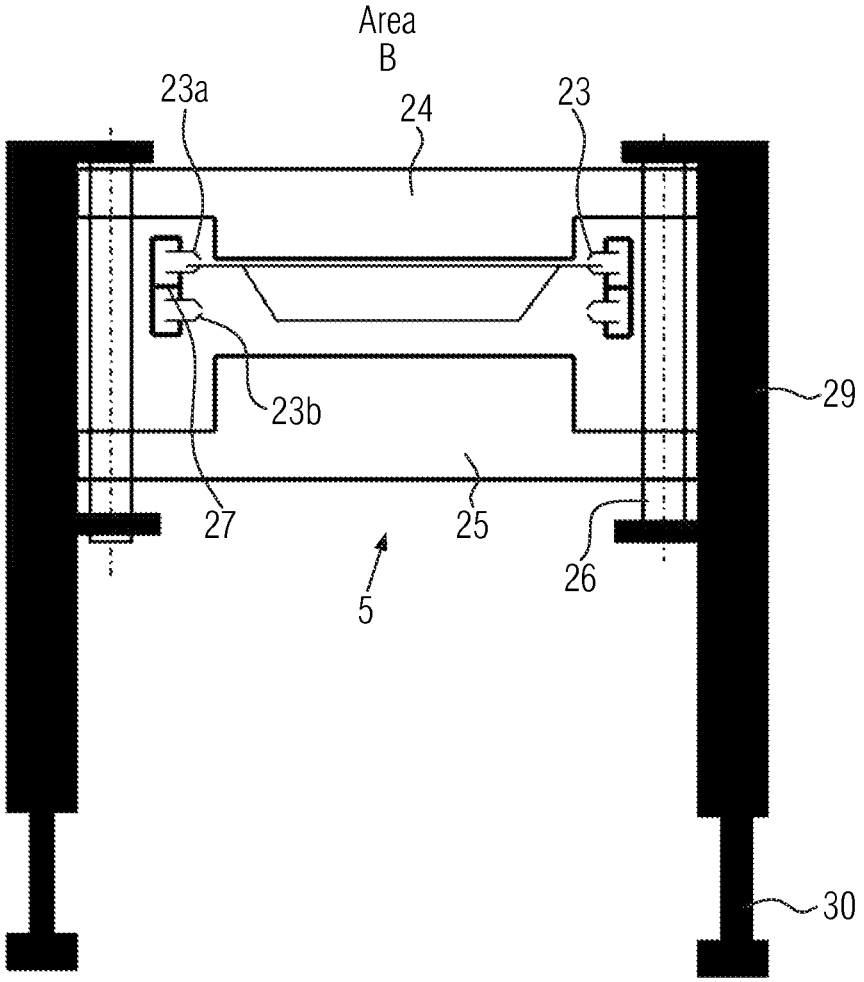
FIG. 5 shows a sectional view through a cutting station with a complete cutting tool in a thermo-forming packaging machine according to the disclosure in the direction of production.

FIG. 5 shows region B as a sectional view in the direction P of production. The frame 29 of the cutting station 5 is presently not connected to the machine frame 6, but is positioned independently on the ground and can by means of positioning elements 30 also be positioned and aligned independently of the machine frame 6. In this, the chain guides 27 and an upper chain strand 23*a* and a lower chain strand 23*b* of the feeding chains 23 are, on the one hand, arranged between the guides 26 and, on the other hand, between the tool upper part 24 and the tool lower part 25. In one embodiment, positioning elements 30 may be adjustable legs on the frame 29 of the cutting station 5 as shown in FIG. 5, wherein the adjustable legs are adjustable in a vertical direction so that the height and/or pitch of the cutting station 5 can be aligned independently of the machine frame 6.

Figure 6:
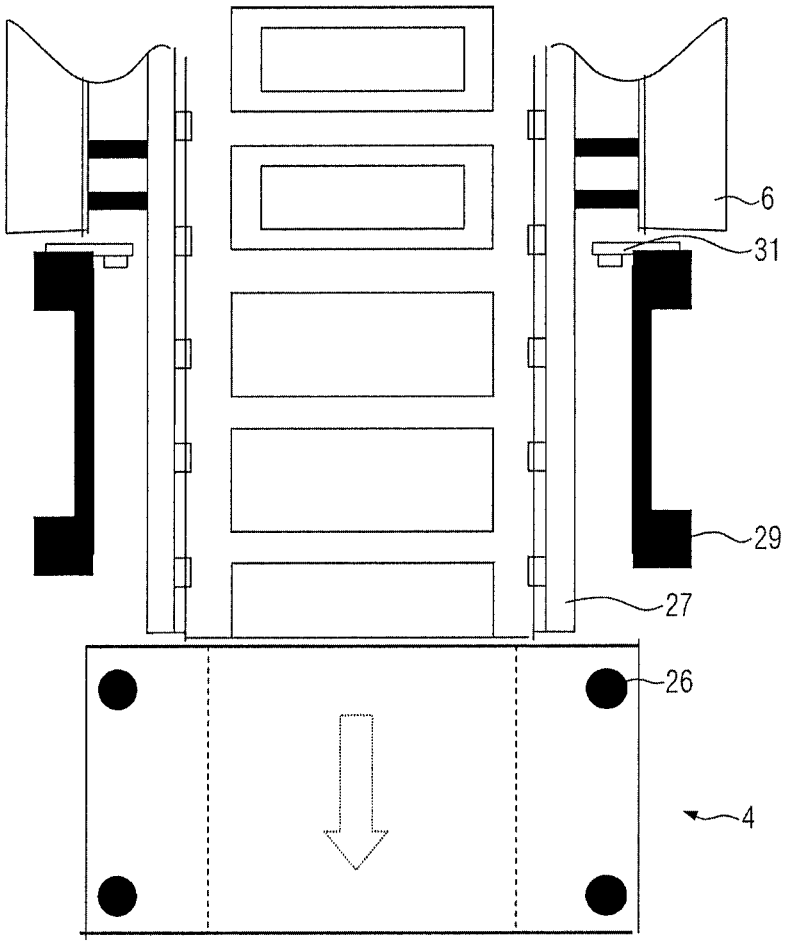
FIG. 6 shows a plan view of the cutting station of FIG. 4 with extracted complete cutting tool.

This embodiment allows an extraction motion of the complete cutting tool 4, for example, also with the guides 26, in the direction P of production from the packaging machine 1, as shown in FIG. 6, because no fastening elements from the chain guide 27 to the machine frame 6 prevent this motion in region B. As an ergonomic facilitation, a tool change carriage can even be run-in against the direction P of production at the back into the packaging machine 1 in order to receive the usually very heavy complete cutting tool 4 and to carry it out of the packaging machine 1. Fixing elements 31 on the frame 29 ensure that, after a change of the complete cutting tool 4, it can be positioned in repeat accuracy on the frame 29 and on the packaging machine 1. For example, fixing elements 31 may be a stop plate, bracket or arm attached to the frame 29 of the cutting station 5 as shown in FIG. 6 so that the complete cutting tool 4 is always positioned at the same position relative to frame 29 of cutting station 5 in the direction P of production (and shown in FIG. 4).

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A thermo-forming packaging machine comprising:

a machine frame having an upstream end and a downstream end;

a forming station on the machine frame for forming containers in a web-shaped material;

a sealing station on the machine frame for sealing the containers, wherein the sealing station is located downstream of the forming station in a direction of production;

a cutting station located downstream of the sealing station and the downstream end of the machine frame in the direction of production, the cutting station including a complete cutting tool having a cutting tool upper part and a cutting tool lower part, wherein the complete cutting tool is extractable from the thermo-forming packaging machine in the direction of production at the cutting station, wherein the direction of production at the cutting station is the direction of conveyance of the web-shaped material through the cutting station; and first and second chain guides mounted on the machine frame, each chain guide for guiding a transport chain that transports the web-shaped material in the thermo-forming packaging machine, and each chain guide having a downstream end portion that extends beyond the downstream end of the machine frame into the cutting station in the direction of production at the cutting station.

2. The thermo-forming packaging machine of claim 1, wherein the cutting tool further comprises multiple guides that are configured to guide movement of at least one of the upper part or lower part of the cutting tool, and the multiple guides of the cutting tool are arranged outside of the transport chain and chain guides.

3. The thermo-forming packaging machine of claim 2 wherein the cutting station further comprises a frame to which the guides of the cutting tool are removably attached, and fixing elements provided on the frame for positioning the complete cutting tool in the cutting station for repeat accuracy.

4. The thermo-forming packaging machine of claim 1, wherein the first and second chain guides cantilever from the downstream end of the machine frame into the cutting station.

* * * * *